United States Patent [19]

Hale

[11] 4,331,166

[45] May 25, 1982

[54] CIGARETTE

[75] Inventor: Robert W. Hale, Bon Air, Va.

[73] Assignee: Philip Morris, Incorporated, New York, N.Y.

[21] Appl. No.: 146,534

[22] Filed: May 2, 1980

[51] Int. Cl.[3] ..... A24D 3/04

[52] U.S. Cl. ..... 131/331; 131/338; 131/339; 131/344; 131/343; 131/88; 131/89; 131/90; 131/92; 131/362; 131/363; 493/42; 493/43; 493/47; 493/49

[58] Field of Search ..... 131/9, 10, 10.3, 10.5, 131/10.7, 10.9, 261 R, 261 B, 274, 331, 338, 339, 340, 341, 343, 344, 347, 361, 362, 363

[56] References Cited

U.S. PATENT DOCUMENTS

| | | | |
|---|---|---|---|
| 2,318,312 | 5/1943 | Curtis, Jr. | 131/10.5 |
| 2,949,116 | 8/1960 | Balkind | 131/10.5 |
| 3,040,752 | 6/1962 | Ganz | 131/10.5 |
| 3,068,873 | 12/1962 | Allman, Jr. | 131/10.5 |
| 3,167,076 | 1/1965 | Mare | 131/10.5 |
| 3,292,635 | 12/1966 | Kolodny | 131/10.5 |
| 3,324,861 | 6/1967 | Gaisman | 131/10.5 |
| 3,373,750 | 3/1968 | Beam | 131/10.5 |
| 3,461,880 | 8/1969 | Stubblefield | 131/261 B |
| 3,499,452 | 3/1970 | Kallianos | 131/17 R |
| 3,648,712 | 3/1972 | Patterson | 131/10.5 |
| 3,828,795 | 8/1974 | Shumaker et al. | 131/17 R |
| 3,830,244 | 8/1974 | Luke | 131/261 B |
| 3,841,338 | 10/1974 | Horsewell et al. | 131/261 B |
| 3,854,384 | 12/1974 | Naylor | 131/261 B |
| 3,855,032 | 12/1974 | Luke | 131/10.5 |
| 3,860,011 | 1/1975 | Norman | 131/10.5 |
| 3,994,306 | 11/1976 | Berger | 131/10.5 |
| 4,022,221 | 5/1977 | Berger | 131/10.5 |
| 4,026,306 | 5/1977 | Berger | 131/10.5 |

FOREIGN PATENT DOCUMENTS

| | | | |
|---|---|---|---|
| 383858 | 1/1965 | Switzerland | 131/10.5 |
| 1371794 | 10/1974 | United Kingdom | 131/10.5 |

*Primary Examiner*—V. Millin.

*Attorney, Agent, or Firm*—Arthur I. Palmer, Jr.; Nelson A. Blish

[57] ABSTRACT

The sensory effect of cigarette smoke is improved by using a disc (24) to shape the flow of smoke (32) leaving smoking article (10) into a divergent pattern, thus increasing the perceived flavor of the cigarette. The effect is most useful with cigarettes having relatively low delivery of particulate matter.

8 Claims, 3 Drawing Figures

CIGARETTE

BACKGROUND OF THE INVENTION

This invention relates to smoking articles in general, and more particularly to a cigarette adapted to give improved sensory effect.

DESCRIPTION OF THE PRIOR ART

The current trend in cigarette manufacturing has been to reduce the concentration of certain components of cigarette smoke. For example, filters made of fibrous materials such as cellulose acetate are used to lower the concentration of particulate matter in the smoke generated during smoking. Ventilation into the filter has been used to further reduce the concentration of particulate matter and also to lower the concentration of gas phase components. Both methods, however, tend to dilute the smoke to such an extent that the flavor of the cigarette is often adversely affected.

Prior art methods of compensating for a deficiency in flavor of cigarette smoke, whether due to cigarette filter or other factors, have met with varying degrees of success. One method of enhansing the flavor of the cigarette has been to add flavor material to the tobacco. Examples of this type solution are disclosed by Schumacher et al, U.S. Pat. No. 3,828,795, and Kallianos et al, U.S. Pat. No. 3,499,452. A drawback associated with this method is that the filter will often reduce or dilute the taste of the flavor additive in the same manner that the cigarette smoke is diluted. A further disadvantage is that the flavorants are often expensive and appreciably increase the manufacturing cost.

Another method of enhancing the perceived flavor of filtered, ventilated cigarettes is to concentrate the smoke leaving the cigarette mouthpiece into a narrow, centralized stream. Examples of this are shown by Norman, U.S. Pat. No. 3,860,011, and by Dwyer et al, U.S. Ser. No. 073,394, filed Sept. 7, 1979. These methods, however, direct the smoke stream against a small area of the smokers mouth or tongue, and consequently may cause a burning sensation. Another disadvantage is that this type of filter with a centralized passage or duct, is more expensive to mass produce than conventional filters.

It is, therefore, an object of the present invention to provide a cigarette that gives increased flavor to the smoker and can be mass produced without major increases in manufacturing costs.

It is also an object of the present invention to provide a cigarette with improved flavor that may be produced with only minor changes in cigarette manufacturing methods.

SUMMARY OF THE INVENTION

According to the present invention, the foregoing and other objects are attained by providing a smoking article with an essentially air impervious disc at the exit of the smoking article. This disc is located at the approximate center of the exit end of the smoking article and forces the smoke entering the user's mouth into an expanding pattern. The effect is most useful with cigarettes having relatively low delivery.

BRIEF DESCRIPTION OF THE DRAWINGS

A more complete appreciation of the invention and many of the attendant advantages thereof will be readily apparent by reference to the following detailed description when considered in connection with the accompanying drawings wherein.

DESCRIPTION OF THE PREFERRED EMBODIMENT

Figure 1:
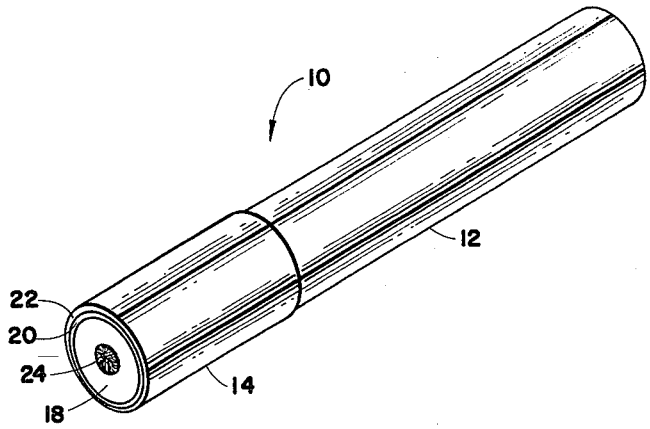
FIG. 1 is a prespective view of a smoking article according to the present invention.

Referring now more particularly to the drawings and specifically to FIG. 1, there is illustrated a preferred embodiment of the invention as it would be used in a smoking article, in this case a cigarette, designated generally by the numeral 10. Cigarette 10 has two major parts, smoking cylinder 12 and filter element 14.

Filter element 14 consists of filter medium 18, plug wrapper 20, and tipping paper 22. Filter medium 18 is cylindrical in shape and substantially conforms to the cross sectional size and shape of smoking cylinder 12. The filter medium 18 may be composed of any known filtering medium or combination thereof, but in the preferred embodiment, the filter medium 18 is cellulose acetate. Filter medium 18 is covered with plug wrapper 20.

The filter medium 18 abuts smoking cylinder 12 and is attached to smoking cylinder 12 in a conventional manner. In the preferred embodiment, filter medium 18 is attached to smoking cylinder 12 by use of tipping paper 22.

Disc 24 is an area on the smoke exit surface of filter medium 18 that has been heat fused. The heat fused area, disc 24, is created by pressing a rod of hot metal, not shown, or other similar object against the smoke exit face of filter medium 18. This method of forming disc 24 creates a small indented area, shown in FIG. 2, which does not detract from the overall appearance of cigarette 10 the thickness of the heat fused disc formed by this method is approximately 0.05 (mm) thick.

Because of the temperature of the metal rod used to form disc 24, and the pressure with which it is applied to the smoke exit surface of filter medium 18, it is not necessary to maintain the metal rod in contact with the filter medium for any length of time. Thus, this method of creating disc 24 is compatible with high speed cigarette manufacturing machines. In the preferred embodiment the metal rod temperature is 360° centigrade (C) and it is applied to filter medium 18 for a period of about one tenth second with sufficient force to heat fuse the cellulose acetate into an air impervious disc.

It has been found that disc 24 functions best when it is near the center of the smoke exit face of filter medium 18 and about three to four millimeters (mm) in diameter. Larger diameter discs tend to increase resistance to draw (RTD) in an unsatisfactory manner and smaller diameter discs fail to achieve the desired effect. In the preferred embodiment, the cigarette diameter is approximately 8 mm.

Figure 2:
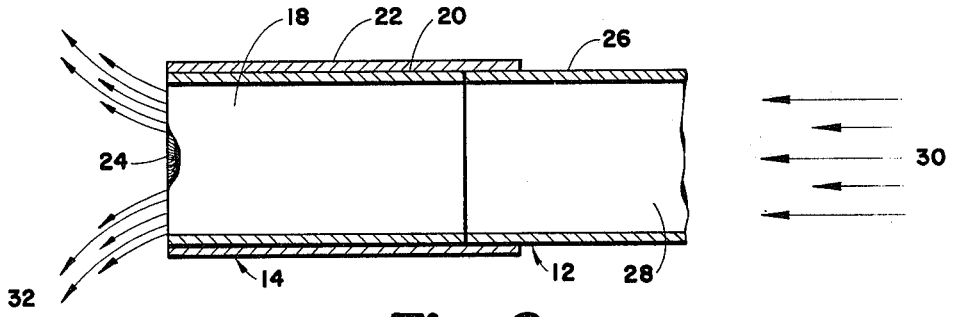
FIG. 2 is a partial longitudinal cross section of the invention shown in FIG. 1.

FIG. 2 shows the effect of disc 24 on smoke delivery patterns. Smoke traveling through smoking cylinder 12, consisting of tobacco rod 28 and cigarette wrapper 26, passes into filter element 14. Smoke reaching the exit face of filter medium 18 cannot pass through disc 24, which is essentially air impervious, and consequently leaves filter element 14 with a radial velocity component. This effect is illustrated by exit smoke 32 in FIG. 2.

While the exact mechanism is not understood, it is believed the expanding cone shape of exit smoke 32, causes particulate matter in the smoke to impact on a larger number of sensors in the smokers mouth than the narrow column of exit smoke from a conventional cigarette. The larger number of sensory receptors contacted, give increased sensory response, or flavor to the smoker.

The invention is most useful when used with low delivery cigarettes. However, stronger cigarettes, sometimes referred to as full flavor cigarettes may produce an undesirable sensation on the tip of the tongue where the cigarette smoke is concentrated, due to the fact that smoke tends to leave cigarettes in a rather narrow column. Thus, the present invention would be useful for this type of cigarette also, since it causes the smoke to impact a larger area of the mouth.

Figure 3:
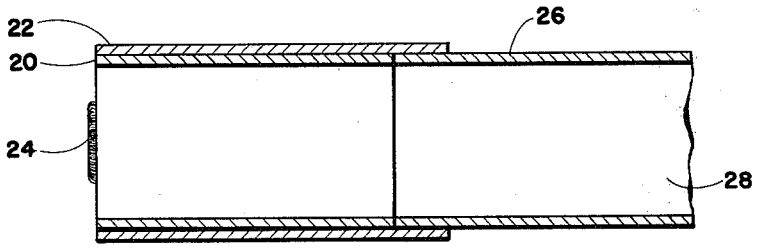
FIG. 3 is a partial longitudinal cross section of an alternate embodiment of the invention.

FIG. 3 shows an alternate embodiment of the invention in which disc 24 is a circular piece of air impervious cellulose acetate which has been glued to the exit face of filter medium 18. The disc 24 may also be formed by placing a drop of triacetine or acetone on the exit face of filter medium 18 or, may be formed by using any of the above in combination. The disc formed by this method is approximately 0.05 mm thick.

Low delivery cigarettes, modified according to the present invention, were subjectively compared with unmodified cigarettes of the same brand by a smoker's panel, and were found to have increase sensory effects. Analytical tests of the modified and control cigarettes showed no significant change in RTD, total particulate matter (TPM), nicotine and dilution.

It is thus seen that this simple and inexpensive modification to cigarettes may be used to increase the sensory response from cigarettes without adjusting the blend or making major changes in filter structure.

It will be understood that the foregoing description is of the preferred embodiment of the invention and is, therefore, merely representative. Obviously there are many variations and modifications of the present invention in light of the above teachings that will be readily apparent to those skilled in the art. For example, the disc may be placed at the end of a smoking article that does not have a filter. It is therefore understood that within the scope of the appended claims the invention may be practiced otherwise than as specifically described.

I claim:

1. A smoking article the improvement which comprises a disc approximately 3 to 4 mm in diameter at the exit of said smoking article which forces smoke leaving said smoking article into a divergent pattern.

2. A smoking article as in claim 1 wherein said disc is located at the exit end of a filter attached to said smoking article.

3. A smoking article as in claim 1 or 2 wherein said disc is located at the approximate center of the exit end of said smoking article or said filter.

4. A smoking article as in claim 1 or 2 wherein said disc is essentially air impervious.

5. A method of making a smoking article the improvement which comprises forming a disc having a diameter of 3 to 4 mm at the exit end of a filter attached to said smoking article.

6. A smoking article as in claim 2 wherein said disc is a heat fused area at the exit end of said filter.

7. A smoking article as in claim 2 wherein said disc is formed by placing a drop of triacetin at the exit end of said filter.

8. A smoking article as in claim 2 wherein said disc is formed by placing a drop of acetone at the exit end of said filter.

* * * * *